United States Patent [19]

Quinan

[11] 4,219,139

[45] Aug. 26, 1980

[54] BOTTOM POURING CRUCIBLE

[75] Inventor: James R. Quinan, Loudonville, N.Y.

[73] Assignee: Albany International Corp., Menands, N.Y.

[21] Appl. No.: 956,509

[22] Filed: Nov. 1, 1978

[51] Int. Cl.[2] ..... B22D 41/10

[52] U.S. Cl. ..... 222/590; 164/336; 222/602; 222/629

[58] Field of Search ..... 222/149, 504, 559, 591, 222/597, 598, 602, 629, 590; 164/336

[56] References Cited

U.S. PATENT DOCUMENTS

| | | | |
|---|---|---|---|
| 2,836,866 | 6/1958 | McMillin | 222/591 X |
| 3,253,307 | 5/1966 | Griffiths et al. | 222/591 X |
| 3,395,840 | 8/1968 | Gardner | 222/591 |
| 4,073,414 | 2/1978 | Garab | 222/149 X |

*Primary Examiner*—David A. Scherbel
*Attorney, Agent, or Firm*—Kane, Dalsimer, Kane, Sullivan & Kurucz

[57] ABSTRACT

A device for metering and transferring liquid metals. It includes a supporting structure and a hollow sleeve open at both ends on the supporting structure. A pouring spout is on one end of the sleeve and has a passageway therethrough communicating with the hollow interior of sleeve. A stopper rod extends into the hollow sleeve from the other end thereof to be shiftable between a position seating on the pouring spout and sealing the passageway therethrough and a position removed from the pouring spout to permit liquid metal to flow into and out of the sleeve. The stopper rod is shiftable between positions and the pouring spout includes a bushing mounted in the passageway and having a threaded opening therethrough and a threaded plug interengaged with the threaded bushing and having an orifice therein to provide for communication between the interior and the exterior of the sleeve through the pouring spout. The device is advantageous for facilitating sealing of the bottom orifice since a crucible of difficult to machine material can be cooperatively arranged with a pouring spout of more easily machinable material to provide the most effective overall crucible structure and an effective seal in the area of the pouring spout. Thus, the structure is effective for bottom pouring crucibles.

21 Claims, 4 Drawing Figures

BOTTOM POURING CRUCIBLE

BACKGROUND OF THE INVENTION

In dealing with the transferring of liquid metals from a furnace by means of a crucible or ladle, there are a number of potential difficulties. One common type of problem deals with handling of certain metals, particularly non-ferrous metals such as aluminum. Molten aluminum is very reactive chemically and therefore very corrosive to metal containers. To combat this problem metal containers or crucibles are occasionally replaced by ceramic or refractory formed or lined components. The difficulty that occurs with this type of structure is that ceramic or refractory components are brittle and easily broken upon impact. Also, some are subject to thermal shock and when they are used with metal, allowance must be provided for low thermal expansion. Accordingly, it is desirable where possible to use metal crucibles or ladles to handle, transport and meter liquid metals. In fact, one type of successful crucible for this purpose is depicted and described in U.S. Pat. No. 4,073,414. The type of structure in that reference has proved to be extremely valuable and useful in overcoming many problems in the liquid metal handling field.

Further improvements are desirable particularly when working with molten metals such as aluminum. Carbon bonded silicon carbide products have been used for melting, holding and pouring crucibles, thermocouple protection tubes, pressure pouring tubes, launders and other devices for handling molten metal, especially non-ferrous alloys. To date, bottom pouring carbon bonded silicon carbide crucible has not been successfully manufactured. The main problem has been sealing the bottom orifice. The extremely hard and coarse silicon carbide grains make the products difficult to machine, especially to cut threaded portions that will be continuous and smooth enough to hold molten metal.

SUMMARY OF THE INVENTION

With the above background in mind, it is among the primary objectives of the present invention to provide a crucible of the type disclosed in the above mentioned U.S. Pat. No. 4,073,414 which is a bottom pouring crucible that is constructable for the most part of carbon bonded silicon carbide and is thus extremely useful in handling non-ferrous metals alloys such as aluminum.

It is an objective to provide a bottom pouring stopper rod type of crucible with the sleeve or barrel formed of carbon bonded silicon carbide and with a pouring spout with a pouring orifice to be sealed by the stopper rod in the manner of the above-referenced patent formed of an easily machinable material so that threaded interengagement can be provided for the pouring spout and leakage avoided with the stopper rod sealing in the most effective manner at the lower orifice end of the crucible. The carbon bonded silicon carbide barrel is formed of a material with a low coefficient of thermal expansion to avoid thermal shock and cracking.

It is an objective to provide a carbon bonded silicon carbide hollow pouring ladle or crucible in the form of a cylinder or sleeve with a flat, rounded or tapered bottom. In forming the crucible, a tapered passageway is machined in the bottom of the sleeve or ladle. The tapered passageway has a larger diameter adjacent the hollow interior of the sleeve and tapers to a smaller diameter at the bottom exit end.

It is an objective of the present invention to machine a mating tapered bushing from a machinable ceramic material or graphite to fit into passageway in the sleeve. The inside through opening of the bushing is threaded to receive a threaded plug of graphite or ceramic material which contains the pouring orifice. Naturally, other well-known types of mating and interengaging surfaces can be formed on the plug and bushing in place of the threads to serve the same purpose. The mating surfaces of the crucible passageway and the exterior of the bushing are coated with a ceramic adhesive and the bushing pushed in place. The ceramic adhesive is cured by air drying and/or application of heat. The sleeve is fitted with a stopper rod as described in the above-referenced patent and the stopper rod is designed to sealingly engage with the pouring spout formed by the bushing and plug combination. In this manner, the crucible of the present invention can be used to pour molten metal such as aluminum.

It is an objective of the present invention to compensate for the extremely hard and coarse silicon carbide grains used in the construction of the crucible sleeve making it difficult to machine, especially to cut threaded portions that are continuous and smooth enough to hold molten metal. The compensation is achieved by the use of a cemented bushing that is machinable and allows the threading operation to be performed on a more favorable material. In this manner, a removably threaded orifice plug can be threadedly interengaged and inserted into the bottom of the silicon carbide crucible by mating interengagement with the threaded bushing.

In summary, a device is provided for metering and transferring liquid metals and includes a supporting structure, a hollow sleeve on the supporting structure and open at both ends, and a pouring spout on one end and having a passageway therethrough communicating with the hollow interior of the sleeve. A stopper rod extends into the hollow sleeve from the other end thereof to be shiftable between a position seating on the pouring spout and sealing the passageway therethrough and a position removed from the pouring spout to permit liquid metal to flow into and out of the sleeve. Means is provided for shifting the stopper rod between positions. The pouring spout includes a bushing mounted in the passageway and having an opening therethrough with a predetermined machined surface thereon and a threaded plug with a predetermined machined surface interengaged with the machined surface of the bushing and having an orifice therein to provide for communication between the interior and exterior of the sleeve through the pouring spout.

The device is formed by forming a tubular hollow crucible body with a passageway at the bottom end. A bushing is mounted in the passageway and a plug with a pouring orifice mounted within the bushing. The material for the bushing and plug is more easily machinable than the material of the cylinder or sleeve thereby facilitating the provision of a bottom pouring crucible designed not to leak.

With the above objectives among others in mind, reference is made to the attached drawings.

DETAILED DESCRIPTION

Crucible 20 of the present invention is designed particularly for use in a metal casting apparatus of a conventional nature. The general structure of device 20 is similar to that disclosed in U.S. Pat. No. 4,073,414, mentioned above, and the contents of that reference are incorporated herein by reference.

Figure 1:
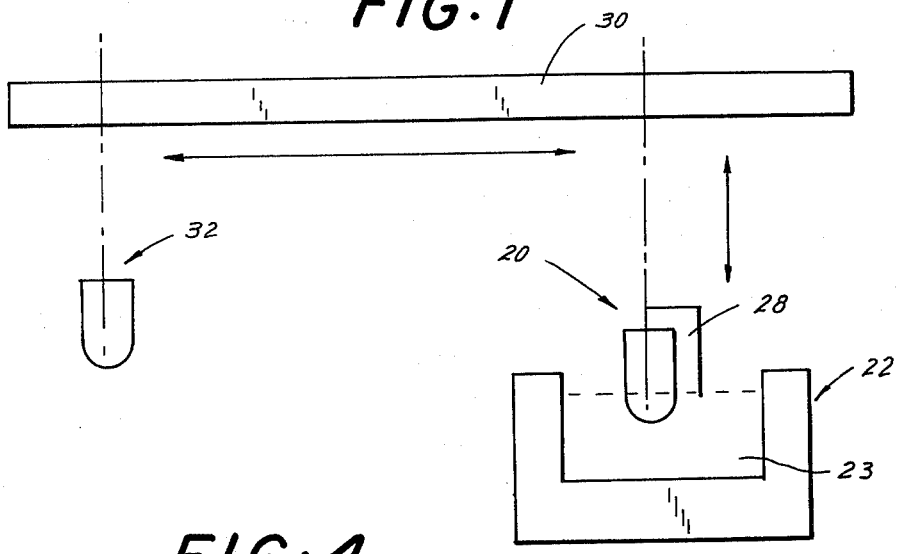
FIG. 1 is a schematic representation of the device of the invention shown as part of a casting apparatus.
Figure 4:
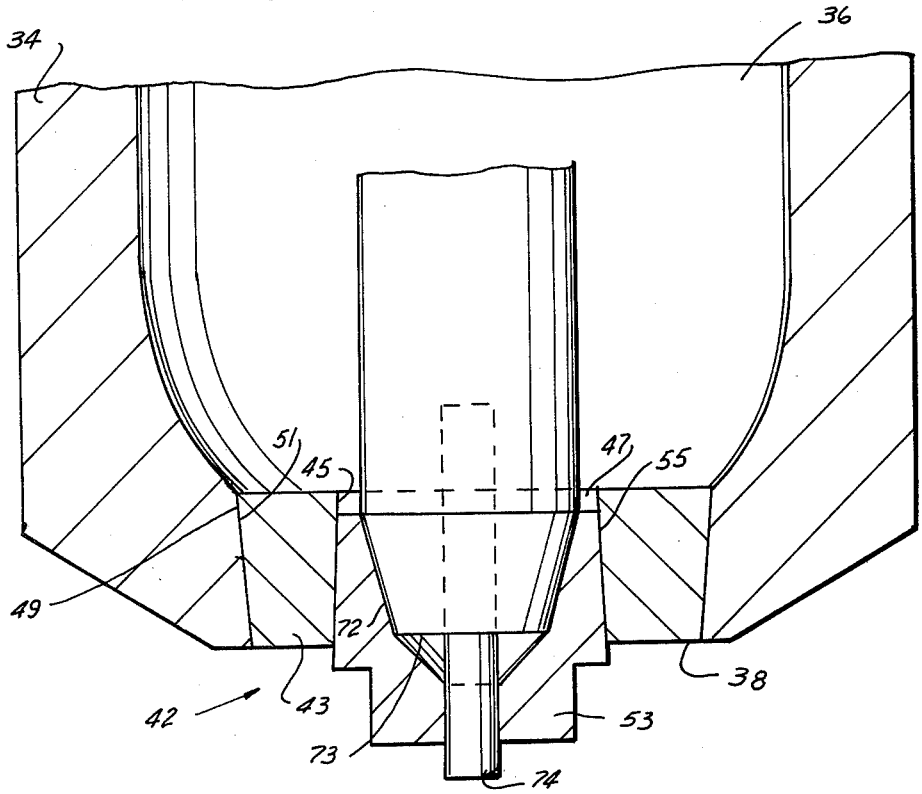
FIG. 4 is an enlarged partially sectional view of the device with the parts in position closing the orifice in the pouring spout.
Figure 2:
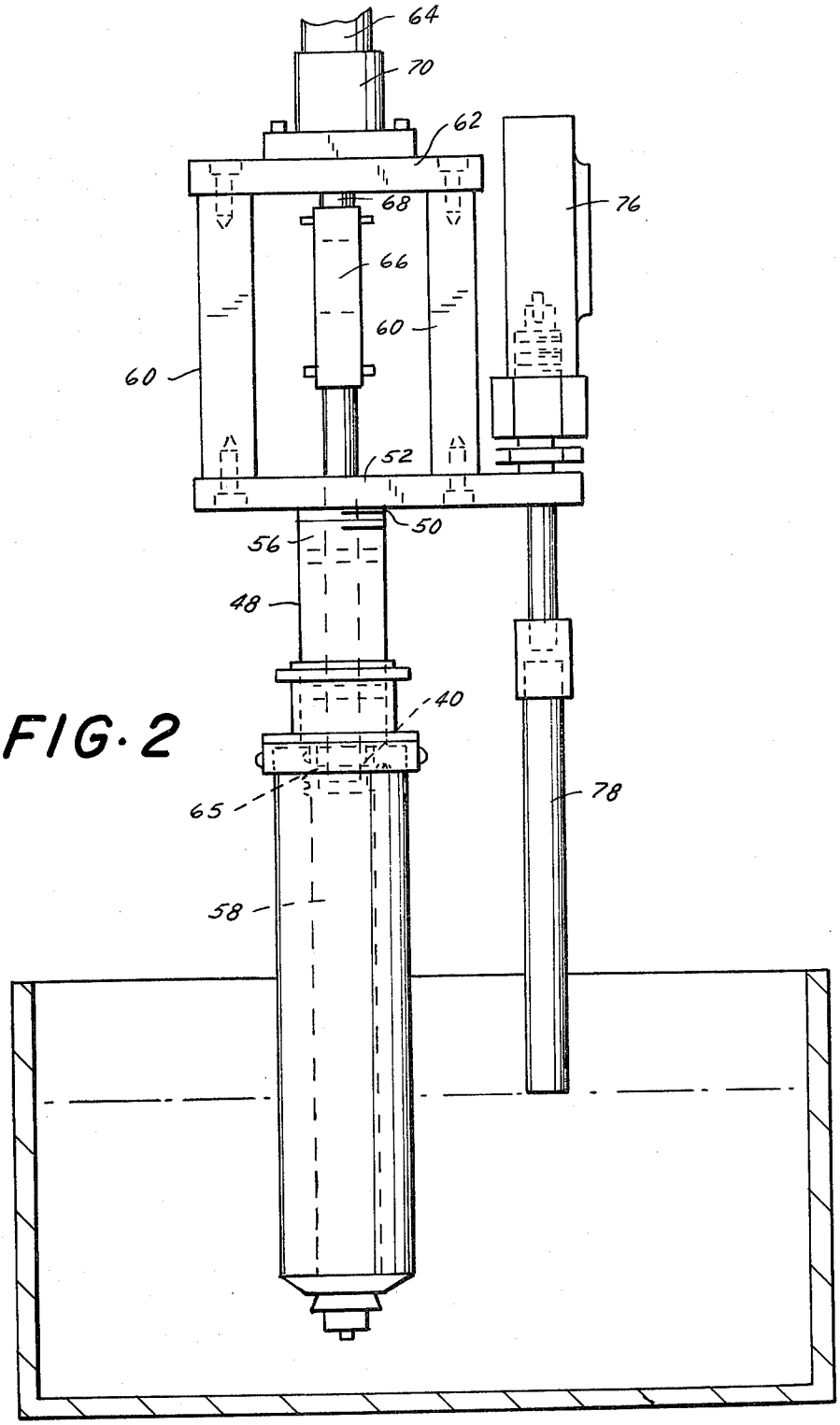
FIG. 2 is an enlarged partially sectional elevation view of the device of the invention shown positioned in a furnace containing molten metal.
Figure 3:
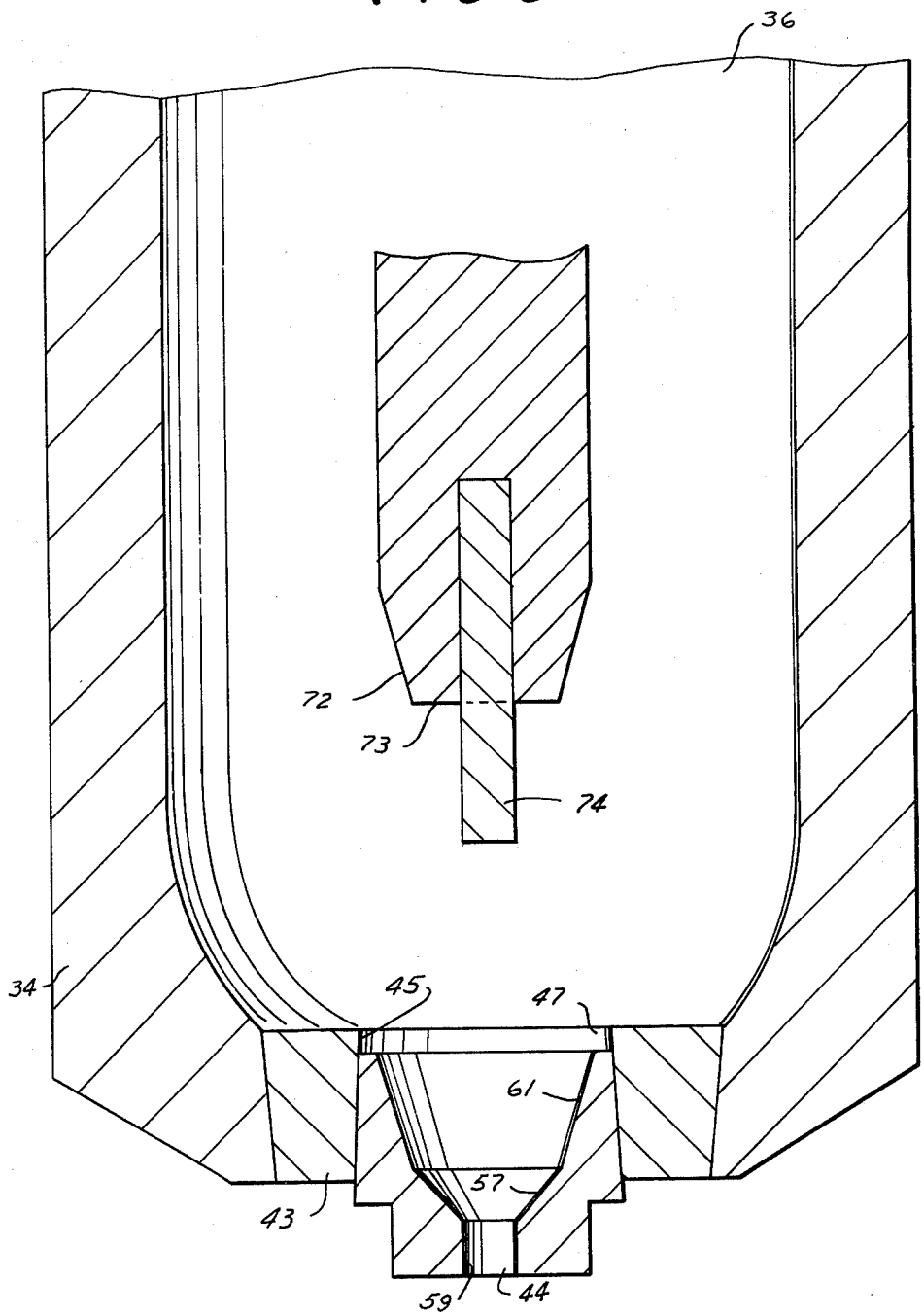
FIG. 3 is an enlarged partially sectional view of the device with parts in position for metal to flow into and out of the orifice in the pouring spout.

The crucible device 20 is designed to be a bottom pouring crucible and is of particular value in handling nonferrous metals and specifically highly corrosive metals such as molten aluminum. An appropriate furnace 22 is provided with a central chamber to hold the molten metal 23 which has been heated in liquid form. Furnace 22 is depicted in FIGS. 1 and 2 with a predetermined amount of molten aluminum 23 positioned therein.

The crucible or ladle device 20 is reciprocally movable into and out of the open top of the furnace and accordingly into and out of the molten metal 23. A probe 28 is used to control the depth of the crucible within the furnace.

The crucible is connected to an over-head guideway and support structure 30 which serves to guide and support the crucible after it has been removed from the furnace and delivered to a further work station such as pouring station 32 whereupon the metal shot contained in the ladle is released into a mold cavity or a shot well.

Crucible 20 includes a sleeve 34 which is hollow to form an inner shot chamber 36. The sleeve has an open bottom end 38 and an open top end 40. Sleeve 34 is formed of a material having a low coefficient of thermal expansion to avoid thermal shock and cracking. A preferable material is carbon bonded silicon carbide. Alternatively, sleeve 34 can be made of alumina, mullite, zirconia and other refractory materials.

At bottom end 38 a pouring spout 42 is coupled with sleeve 34 to close off the open bottom end. The pouring spout includes a hollow bushing 43 having a threaded inner surface 45 surrounding a through opening 47 and a tapered outer surface 49 which mates with a tapered surface 51 surrounding the passageway in the bottom end of sleeve 34. The taper of the mating surfaces between the bushing and the sleeve is such that it has a larger diameter adjacent to chamber 36 and tapers to a smaller diameter at the bottom end of the sleeve.

Pouring spout 42 includes a second component, a plug 53 which has a threaded outer surface 55 for interengagement with the threaded inner surface of bushing 43 to facilitate the coupling of the two components of pouring spout 42 together. A passageway extends through plug 53 to form a pouring orifice 44. The orifice 44 has a narrow diameter adjacent to its lower end is stepped with an angular change to form a tapered wider diameter portion 57 extending from the narrow portion 59 at the bottom end of the orifice and tapering outwardly to communicate with a further differently angled outwardly tapering portion 61 extending to the upper end of plug 53. The configuration of orifice 44 is designed for releasable sealing engagement with the stopper rod assembly as will be discussed in detail below. The tapered or chamfered portions 57 and 61 facilitate the sealing act.

In construction, tapered passageway 51 at the bottom of sleeve 34 is machined and the mating tapered bushing 43 is machined as well from a machinable ceramic material or graphite to fit into the passageway so that the outer surface 49 of the bushing mates with the surface 51 forming the walls of the passageway and the sleeve.

The inside bore or opening 47 in the bushing is threaded to receive threaded outer surface 55 of plug 53 to complete the assembly of pouring spout 42. Plug 53 is also formed of a graphite or a machinable ceramic material thereby facilitating the assembly of the parts of the pouring spout to avoid leakage independent of the material used for sleeve 34.

Mating surfaces 49 and 51 of the bushing 43 and sleeve 34 respectively are coated with a ceramic adhesive and the bushing 43 is pushed in place. The ceramic adhesive is cured by air drying and/or application of heat. The crucible is thus complete and ready for fitting with a stopper rod as discussed below and as described in the above referenced patent.

In this manner, a silicon carbide crucible can be used for a bottom pouring crucible without the presence of a seating and sealing difficulty with respect to the orifice at the bottom end. Previously, it has been conventional to use a silicon carbide crucible when the crucible is tipped and the metal poured over the top usually with the use of a lip or spout at the upper end.

The extremely hard and coarse silicon carbide grains used in the construction of the crucible make it difficult to machine, especially to cut threaded portions that are continuous and smooth enough to hold molten metal. The use of a cemented bushing that is machinable allows the threading operation to be performed on a more favorable material. In this manner, a removable threaded orifice plug can be inserted into the bottom of a silicon carbide crucible.

Pinned to the upper surface of sleeve 34 is a connecting nipple 48 which has a metal ring to couple with the sleeve and also a threaded upper end for threaded interengagement with a threaded aperture 50 and a horizontal supporting plate 52. The supporting plate is mounted to a pair of opposing upright supports 60 which are interconnected with a top plate 62. The top plate is in connection with the main top supporting structure 64 which extends into conventional interconnection with the guideway 30.

Stopper rod 58 is coupled at its upper end by a conventional coupler 66 to the drive shaft 68 of a drive means 70. The drive means is conventional and is designed to vertically reciprocate stopper rod 58 and to rotate the stopper rod a predetermined amount of turn after seating. A turn of approximately 90 degrees has been found to work effectively.

A conventional main drive mechanism is utilized to lift the entire device 20 and the interconnected supporting structure described above upward and to lower it accordingly in connection with furnace 22.

Stopper rod 58, which may be segmented by optional coupling 65 to provide height adjustment and facilitate the removal and replacement of the tip end, has a beveled or a chamfered surface 72 connected to a beveled transition segment 73 adjacent its elongated tip 74.

When the rod 58 is in the full downwardly extended position its chamfered lower end 72 mates with a portion of the chamfered portions 57 and 61 of orifice 44 in the pouring spout to form a sealing interengagement therewith and close the orifice. The total length of transition segment 73 and tip 74 is slightly longer than the remainder portion of orifice 44 and therefore at the same time extends beyond the bottom end of the pouring spout. Additionally, tip 74 is of slightly less diameter than orifice lower portion 59 providing a slight clearance therebetween.

A probe support 76 is aligned with an upright support 60 and is interconnected therewith by a laterally extending arm 78. This spaces the probe support 76 laterally from the ladle and permits the vertical extension of a probe 78 downward to the surface of the molten metal. Probe 78, a conventional conductor, is utilized to determine electrically its contact with the molten metal and consequently regulates the depth of the immersion of the ladle into the molten metal.

In use, the components of the ladle are in the position as depicted in FIG. 2, initially. Tip 74 is housed in the pouring spout orifice and a sealing interengagement exists between the beveled or chamfered portions 72, 57 and 61. The ladle is guided into alignment with the furnace 22 and the main drive structure is actuated to lower the ladle into the molten metal 23 and the furnace 22 until probe 78 makes contact with the metal and thereby signals the cessation of the vertical downward movement of the ladle. As the ladle enters the molten metal it passes through a layer of dross or slag on the top surface thereof. The presence of the tip extending beyond the lower end of the orifice in the pouring spout substantially prevents entry of the slag or dross into the orifice thereby protecting the opening into the chamber 36.

When the ladle is at the submerged downward filling position, the actuator mechanism 70 is automatically activated to lift stopper rod 58 upward. The molten metal then passes through orifice 44 into the chamber 36 to the predetermined height at which the stopper rod 58 is lowered to close orifice 44. Since the pouring spout is below the slag level there is no introduction of slag or dross into the chamber. In this manner, the desired shot of molten metal is contained within the ladle.

Actuator 70 is then activated to drive the stopper rod 58 downward and then rotate the stopper rod after seating into its initial position. The rotating action helps effect the seal between chambered surfaces 72 and 57 and 61. A hydraulic pump can be provided as part of the drive mechanism 70 for the stopper rod to exert a slight pressure on the rod in the downward direction and further effect a positive seal between the chamfered surfaces and prevent any leakage of metal from the chamber 36.

The main drive mechanism is then activated to lift the ladle and supporting structure out of the furnace. As this occurs, the presence of tip 74 prevents collection of dross 26 within orifice 44 in the same manner as it prevented such collection in the downward movement in the furnace. Additionally, there is slight clearance between tip 74 and orifice 44 so that any excess metal can drip out of the bottom of the pouring spout as the ladle is lifted.

Once the ladle is removed from the furnace 22, the main drive mechanism then traverses the ladle and supporting structure to the pouring station 32 at which time the stopper rod will be again activated by mechanism 70 and will be vertically lifted to open orifice 44 and permit the shot of metal within chamber 36 to pour through orifice 44 into a shot well or mold. In this manner, accuracy of the orifice opening 44 is maintained through an extended period of time. Furthermore, the chance of dross being entrained in the molten metal shot exiting from chamber 36 is minimized and in most cases completely eliminated. Consequently, a pure charge of molten metal is introduced into the mold.

The procedure is then repeated with the main drive mechanism which is, as described above, a hydraulically actuated cylinder that traverses the ladle back to the furnace for a repeat procedure. Appropriate timing mechanisms (not shown) can be provided to determine the time for each step in the procedure.

Central opening 56 is provided on the top of the ladle to permit gases to escape at high velocity including the forcing of air out through the upper end of the ladle. At the same time, the high velocity movement of gases out of the ladle will serve to substantially deter and in most cases prevent air from reentering through the top of the ladle and reacting with the molten metal. Appropriate safeguards against leakage are provided including the provision of the rotational movement in seating chamfered surface 72 on chamfered surface 57 and 61, by providing a seating pressure on stopper rod 58 such as 50 psi, and by providing the chamfered seating areas at the point of seal. Also easy removal and replacement of the rod and spout can be accomplished with the present structure whenever the chamfered areas become worn or corroded.

Repeated metering accuracy is obtained by maintaining a constant size orifice in the spout. Orifice size change may be the result of wear between rod tip 74 and spout 42 or metal and dross build up on the same parts. Wear is controlled by providing a somewhat larger diameter to orifice 44 in the spout 42 than the diameter of rod tip 74. The rotary motion of tip 74 also guards against build up upon each lowering of the rod. Further, the diameter differential between the tip 74 and orifice 44 permits drainage below the chamfered seal of the liquid metal back into the furnace upon removal of ladle 20.

Decreased dross formation in the ladle is accomplished by air, which is necessary to form dross, being forced, by the hot gases emanating from the molten metal, through the clearance between opening 56 and rod 58. Return of air is primarily prevented by the rapid cycle of operation.

Decreased dross entrainment in the liquid metal results from providing the tip 74 with sufficient length to extend beyond the bottom end of spout 42 when the ladle is lowered into the furnace 22 thereby preventing a pickup of dross 26 from the top of the liquid metal 23. Rod 58 is lifted only after spout 42 is below the dross level and closed again before the ladle 20 is removed from the furnace 22.

An example of a successful crucible 20 of the above design was constructed in the following manner. A carbon bonded silicon carbide ladle cup having a six inch outer diameter, a four and one-half inch inner diameter and 29 inches long was obtained from Ferroelectro Corporation. The top was open while the bottom had about a two inch tapered annular section ending in about a three inch diameter flat base. The bottom 14 inch portion was cut off with a band saw and used to make the crucible.

A three inch bottom diameter, five degree tapered hole was machined in the flat bottom base with the larger diameter being at the internal end. A mating five degree bushing was machined from a piece of aluminum silicate (Aremcolox 502-1300 machinable ceramic) to fit into the crucible hole. The inside bore of the bushing was threaded (NPT) to receive a standard one and three-quarter inch graphite pipe plug with the pouring orifice.

Four holes were drilled through the top of the cylinder for fastening to an outside metal ring and plate which, in turn, can be attached to the crucible nipple.

The mating surfaces of the crucible hole and ceramic bushing were coated with a ceramic adhesive (Cotronics 901, made from high-purity ceramic fibers and inorganic binders) and the bushing pushed into place. Excessive adhesive that squeezed out was wiped away. The adhesive was allowed to dry 24 hours and then the crucible was suspended over the furnace for two hours to insure complete drying.

The above described crucible was used successfully in the following manner. A one inch diameter graphite stopper rod with a tungsten carbide tip, a graphite plug and the combined sleeve and bushing parts of the crucible were then assembled in a test stand. The furnace contained 356 aluminum at 1250° F.

After a 10 minute pre-heat in the metal, the plug was hand tightened, and vertical cycling was started at about four pours per minute. After 170 pours the test was stopped and the crucible allowed to cool, without loosening the plug, to see if the seating area would fail due to expansion or contraction. It was preheated again, the cycle started, and allowed to continue the rest of the day for a total of 870 pours. There was no leakage.

The following day the test was resumed and continued satisfactorily for a total of 2,000 pours.

Thus the several aforenoted objects and advantages are most effectively attained. Although several somewhat preferred embodiments have been disclosed and described in detail herein it should be understood that this invention is in no sense limited thereby and its scope is to be determined by that of the appended claims.

I claim:

1. In a device for metering and transferring liquid metals including a supporting structure, a hollow sleeve on the supporting structure and open at both ends, a pouring spout on one end and having a passageway therethrough communicating with the hollow interior of the sleeve, a stopper rod extending into the hollow sleeve from the other end thereof to be shiftable between a position seating on the pouring spout and sealing the passageway therethrough and a position removed from the pouring spout to permit liquid metal to flow into and out of the sleeve, means for shifting the stopper rod between positions, the improvement comprising; the pouring spout including a bushing mounted in the passageway and having an opening therethrough with a predetermined machined surface thereon and a threaded plug with a predetermined machined surface interengaged with the machined surface of the bushing and having an orifice therein to provide for communication between the interior and exterior of the sleeve through the pouring spout, the sleeve being formed of a difficult to machine material and the machined surfaces on the bushing and plug being mating threaded surfaces, and the mating surfaces of the passageway in the sleeve and the bushing being bonded together.

2. The invention in accordance with claim 1 wherein the sleeve is formed of carbon bonded silicon carbide material.

3. The invention in accordance with claim 1 wherein the bushing and plug are formed of a relatively easily machinable material in comparison to the material of the sleeve.

4. The invention in accordance with claim 3 wherein the bushing is formed of one of a machinable ceramic material and graphite.

5. The invention in accordance with claim 3 wherein the plug is formed of one of a machinable ceramic material and graphite.

6. The invention in accordance with claim 1 wherein the passageway in the sleeve is formed as a tapered hole tapering from a larger diameter on the interior to a smaller diameter on the exterior of the sleeve, the bushing having a corresponding tapered outer surface to mate with the surface forming the passageway in the sleeve.

7. The invention in accordance with claim 1 wherein the bonding between the outer surface of the bushing and the inner surface of the passageway is achieved by use of a ceramic adhesive coated on the mating surfaces and cured by air drying and/or application of heat.

8. The invention in accordance with claim 1 wherein the metal to be metered and transferred is a molten non-ferrous metal.

9. The invention in accordance with claim 1 wherein the stopper rod and the pouring spout have mating surfaces thereon to facilitate sealing engagement therebetween when the stopper rod is in the seating position to prevent leakage, means for shifting the stopper rod between positions including axial drive means and rotary drive means to permit the stopper rod to be rotated with respect to the pouring spout and sleeve and to be axially shifted with respect to the pouring spout and sleeve and operating so that when the stopper rod is directed into mating engagement with the pouring spout it will be both axially and rotatably brought into mating engagement thereby facilitating sealing of the stopper rod and pouring spout to prevent leakage, means for transferring of the device into and out of a container of liquid metal with the stopper rod being in the seated position on the pouring spout during insertion into the liquid metal to facilitate prevention of accumulation of undesirable materials within the hollow sleeve during the insertion into the liquid metal to the desired depth, means for cleaning the orifice and for preventing undesirable materials for collecting in the orifice including the end of the stopper rod adjacent the pouring spout having a smaller diameter tip portion extending therefrom of a predetermined length so that when the stopper rod is seated in sealing position on the pouring spout the tip will extend through the orifice in the pouring spout thereby guarding against the accumulation of undesirable materials in the orifice while the device is being transferred into a container of liquid metal, and when the stopper rod is removed from the seating position on the pouring spout the tip will be removed therefrom to permit liquid metal to freely flow through the orifice in the pouring spout and the tip acting to remove any collection of undesirable material from the orifice upon reinsertion therein as it is rotated and axially moved with the stopper rod as the stopper rod is reseated on the pouring spout.

10. The invention in accordance with claim 1 wherein means is provided for transferring the device from the location of a furnace containing liquid metal to a pouring station whereupon liquid metal within the sleeve can be poured upon shifting of the rod to the position removed from the pouring spout, and timing means being provided to determine the time at which the stopper rod will be positioned in each of the two positions with respect to the pouring spout.

11. The invention in accordance with claim 1 wherein the mating surfaces between the stopper rod and the pouring spout are beveled to facilitate seating engagement therebetween, and pressure means being provided to produce a slight pressure on the stopper rod when it is seated with respect to the pouring spout thereby providing a more positive seating interengagement therebetween.

12. The invention in accordance with claim 1 wherein the end of the sleeve distal from the end connected to the pouring spout has drilled holes and the supporting structure adjacent thereto has a threaded surface, a tubular pipe nipple having a passageway therethrough and threaded outer surface portions at both ends with the nipple being threadedly interengaged with the the threaded surfaces on the supporting structure and a metal plate and ring which is interengaged by pins to the adjacent end portion of the sleeve in position for passage of the stopper rod through the nipple and thereby interconnecting the sleeve to the supporting structure, the means for shifting the stopper rod between positions including axial drive means and rotary drive means to permit the stopper rod to be rotated with respect to the pouring spout and sleeve and to be axially shifted with respect to the pouring spout and sleeve, and pressure means provided to produce a slight pressure on the stopper rod when it is seated with respect to the pouring spout so that the combined axial shifting, rotation and pressure provide a more positive seating interengagement.

13. In a method of forming a device adapted for metering and transferring liquid metal including forming a crucible structure including a pouring spout and a stopper rod shiftable between a position seating on the pouring spout and sealing the orifice therein and a position removed from the pouring spout to permit liquid metal to flow into and out of the crucible, the improvement comprising; forming the pouring spout of a bushing mounted in a passageway in the surrounding crucible structure and having an opening therethrough with a predetermined machined surface thereon and a plug with a predetermined machined surface interengaged with the machined surface of the bushing and having the orifice therein to provide for communication between the interior and exterior of the sleeve through the pouring spout, the crucible structure surrounding the pouring spout being formed of a difficult to machine material and the machined surface on the bushing and plug being mated threaded surfaces, and the mating surfaces of the bushing and adjacent crucible structure being bonded together.

14. The invention in accorddance with claim 13 wherein the liquid metal to be transferred is a non-ferrous metal.

15. The invention in accordance with claim 14 wherein the passageway in which the bushing is mounted is tapered with a wider diameter and adjacent the interior of the crucible and the narrow diameter end adjacent the exterior of the crucible and the bushing having a corresponding outer surface tapered to mate therewith.

16. The invention in accordance with claim 14 wherein the bushing is formed of an easily machinable material in comparison to the material of the surrounding crucible structure.

17. The invention in accordance with claim 16 wherein the bushing is formed of one of a machinable ceramic material and graphite material.

18. The invention in accordance with claim 14 wherein the plug is formed of an easily machinable material in comparison to the material of the surrounding crucible structure.

19. The invention in accordance with claim 18 wherein the plug is formed of one of a machinable ceramic material and graphite material.

20. The invention in accordance with claim 14 wherein the bonding between the mating surfaces of the crucible and the bushing is accomplished by coating those surfaces with a ceramic adhesive, pushing the bushing in position so that the mating surfaces are in alignment, and curing the ceramic adhesive by air drying and/or application of heat.

21. The invention in accordance with claim 7 wherein the difficult to machine material is a carbon bonded silicon carbide.

* * * * *

UNITED STATES PATENT AND TRADEMARK OFFICE

CERTIFICATE OF CORRECTION

PATENT NO. : 4,219,139

DATED : August 26, 1980

INVENTOR(S) : JAMES R. QUINAN

It is certified that error appears in the above-identified patent and that said Letters Patent are hereby corrected as shown below:

In The Claims:

At Col. 10, line 42, "7" should read --13--.

Signed and Sealed this

*Sixth* Day of *January 1981*

[SEAL]

*Attest:*

SIDNEY A. DIAMOND

*Attesting Officer*

*Commissioner of Patents and Trademarks*